US007135949B2

(12) United States Patent
Reppe et al.

(10) Patent No.: US 7,135,949 B2
(45) Date of Patent: Nov. 14, 2006

(54) TRANSFORMER OR INDUCTOR CONTAINING A MAGNETIC CORE HAVING ABBREVIATED SIDEWALLS AND AN ASYMMETRIC CENTER CORE PORTION

(75) Inventors: John Reppe, Watertown, SD (US); Dean E. Huumala, Hayti, SD (US); Jimmy D. Holdahl, Watertown, SD (US); Todd Settergren, Watertown, SD (US)

(73) Assignee: Tyco Electronics Corporation, Middletown, PA (US)

( * ) Notice: Subject to any disclaimer, the term of this patent is extended or adjusted under 35 U.S.C. 154(b) by 270 days.

(21) Appl. No.: 10/891,587

(22) Filed: Jul. 15, 2004

(65) Prior Publication Data

US 2006/0012457 A1 Jan. 19, 2006

(51) Int. Cl.
*H01F 27/02* (2006.01)

(52) U.S. Cl. ..... 336/83; 336/212

(58) Field of Classification Search ..... 336/65, 336/83, 178, 200, 212, 223–234
See application file for complete search history.

(56) References Cited

U.S. PATENT DOCUMENTS 3,371,301 A * 2/1968 Hisano ..... 336/83
4,760,366 A 7/1988 Mitsui ..... 336/233
5,489,884 A * 2/1996 Heringer et al. ..... 336/210
5,886,610 A * 3/1999 Canova ..... 336/83
6,483,412 B1 11/2002 Holdahl et al. ..... 336/192
6,501,362 B1 12/2002 Hoffman et al. ..... 336/198
6,696,913 B1 2/2004 Meuche et al. ..... 336/208
6,897,754 B1 * 5/2005 Jeong et al. ..... 336/83
7,078,995 B1 * 7/2006 Hoffman et al. ..... 336/83

* cited by examiner

*Primary Examiner*—Tuyen T Nguyen

(57) ABSTRACT

An inductor or transformer for mounting on a PCB has a two-part magnetic core structure and at least one coil wound on a bobbin. Each core part has a backwall and an abbreviated outer skirt extending from the backwall and an asymmetric center core element extending from the backwall in the same direction as the outer skirt along a longitudinal axis parallel with the mounting plane and including the centroid of the center core element. The center core element is asymmetric relative to a dividing plane parallel with the mounting plane and including the longitudinal axis, such that a greater portion of the center core element lies on a side of the dividing plane than on an opposite side of the dividing plane. In one preferred form, the center core element has a cross-sectional shape resembling a "D" character turned on its side, or "lazy D" shape.

38 Claims, 3 Drawing Sheets

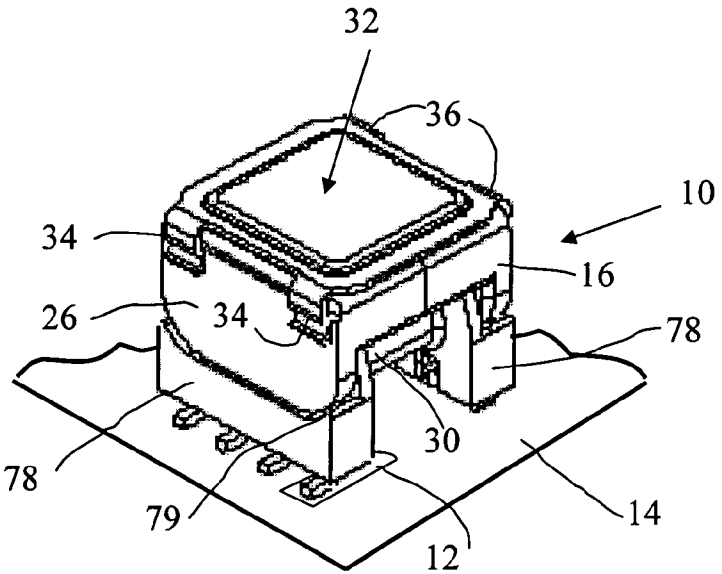
Figure 1
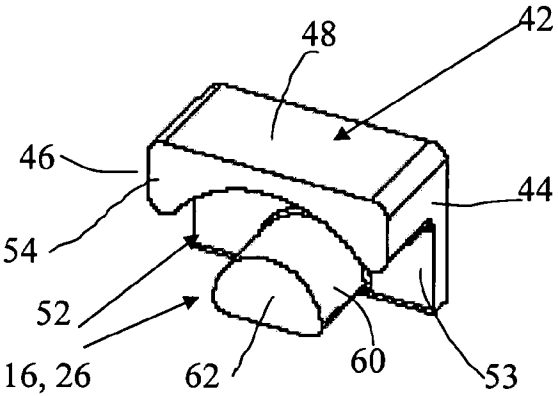
Figure 2
Figure 3
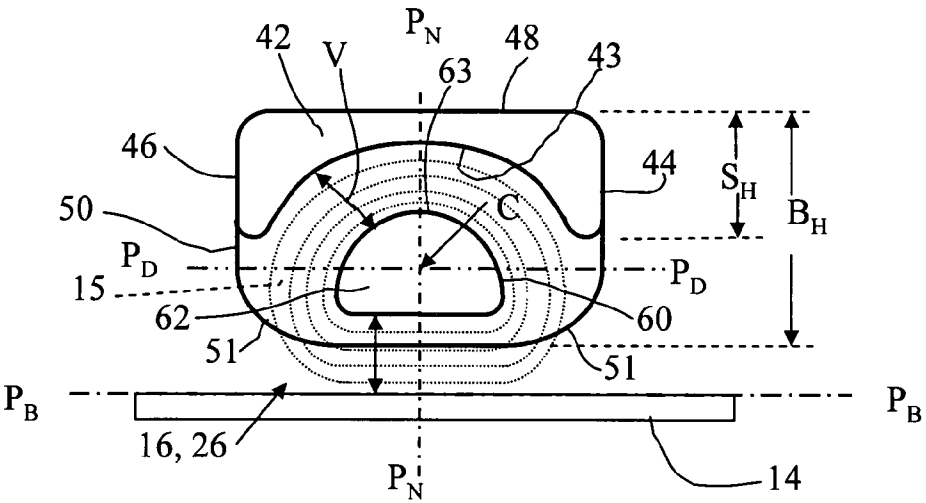
Figure 4

TRANSFORMER OR INDUCTOR CONTAINING A MAGNETIC CORE HAVING ABBREVIATED SIDEWALLS AND AN ASYMMETRIC CENTER CORE PORTION

BACKGROUND OF THE INVENTION

1. Field of the Invention

This invention relates to an electric device in the form of a transformer or an inductor, having a two-part magnetic core; and this invention relates to cross-sectional geometry and resultant shape of a magnetic core part of such a device.

2. Introduction to the Invention

Electrical devices for use as transformers and inductors commonly comprise a magnetic core inserted into a bobbin around which one or more wire coils are wound. When used for power supply, data, or telecommunications applications, such devices are mounted on printed circuit boards (PCBs), along with other electronic elements. Due to the large number of elements present on the board, it is important that the amount of space occupied by the electrical device be minimized. However, it is also important that the electrical device maintain a certain level of performance required for maximum data or power throughput. The conventional approach for reducing the area occupied by the device is to use a smaller conventional part. However, this can give disadvantages in terms of leakage inductance, DC resistance, and total harmonic distortion.

A conventional transformer, such as that disclosed in U.S. Pat. No. 6,483,412 (Holdahl et al.), is positioned so that the core, which has a generally rectangular shape with curved edges, is perpendicular to the PCB, so as to minimize the amount of space used on the printed circuit board. It is typically surface-mounted onto the PCB by means of self-leaded terminals or pins extending from a structure forming a coil bobbin, the terminals or pins being aligned with and bonded to circuit traces or pads of the PCB.

Heretofore it has been assumed by workers in the art, that in shielded core geometries the sidewalls of the skirt and the back plane must extend down the same distance. In addition, it has been assumed that the central core portion of the magnetic core structure should be provided with a symmetrical cross-sectional shape. By "symmetrical" it is meant that the central core portion can be divided into similar halves by a plane parallel to the device mounting plane and passing through a center of mass, i.e., centroid, of the central core portion. For example, U.S. Pat. No. 4,760,366 (Mitsui) illustrates a ferrite core having a central core portion including circular ends and a flattened rectangular central region, rendering the resultant core structure and electrical device relatively wide and thereby unduly consumptive of valuable PCB space. Commonly assigned U.S. Pat. No. 6,483,412 (Holdahl et al), U.S. Pat. No. 6,501,362 (Hoffman et al.) and U.S. Pat. No. 6,696,913 (Meuche et al.) attempted to reduce the PCB footprint of the electrical device by orientating the central core region perpendicularly relative to the PCB mounting plane. In these prior examples the sidewalls of the skirt and the back plane extend downwardly toward the mounting surface or plane by the same distance. Another limitation of these prior art electrical devices is that the central core regions are symmetrical about a plane parallel to the PCB mounting plane and passing through the center of each central core region. While these approaches have resulted in usable electrical devices, the reorientation to vertical of the oblong or flattened symmetrical central core region has necessarily extended the resultant height of the device above the PCB surface, creating issues with regard to adjacent PCB board spacing and mechanical integrity of the surface mounting arrangement.

A hitherto unsolved need has remained for an electrical device having both a reduced footprint and a reduced mounting height above the PCB.

BRIEF SUMMARY OF THE INVENTION

A general object of the present invention is to provide an electrical device in the form of a transformer or an inductor with a two-part magnetic core wherein the sidewalls of the skirt extend down an abbreviated distance in comparison to the back wall thereby reducing resultant device footprint while improving electrical performance of the device in a manner overcoming limitations and drawbacks of the prior art.

Another general object of the present invention is to provide an electrical device in the form of a transformer or an inductor with a two-part magnetic core wherein the central core portion is asymmetric, thereby reducing resultant device height above a mounting plane in a manner overcoming limitations and drawbacks of the prior art.

Another object of the present invention is to provide a central core portion of a magnetic core part with an asymmetric cross-sectional lazy "D" shape relative to the device mounting plane, for example.

Another object of the present invention is to provide a core skirt portion of a magnetic core part having abbreviated dependent sidewalls so as to optimize a volume occupied by a transformer or inductor including the magnetic core part thereby optimizing the device footprint on a PCB mounting surface.

In accordance with principles and aspects of the present invention, an electrical device is provided for mounting on a PCB defining a mounting plane or surface. The device includes a multi-part magnetic core structure and at least one coil included within the multi-part magnetic core structure. The multi-part magnetic core structure includes first and second core halves. Each core half has a backwall and an outer skirt extending from the backwall. The backwall and an abbreviated outer skirt are formed of a first magnetic material. The abbreviated skirt includes dependent sidewalls that are shortened relative to the dependent length of the backwall. The abbreviated skirt also defines an inner surface that is complementary to a facing surface of an asymmetric center core, so that an interior volume for receiving a coil or coils is substantially uniform.

In one preferred embodiment each core half also includes an asymmetric center core element extending from the backwall in the same direction as the outer skirt along a longitudinal axis parallel with the mounting plane and including the centroid of the center core element. In another preferred embodiment the asymmetric center core element is formed as a third element separately from the core halves, and is sized to extend between the backwalls of the core halves upon assembly of the device. The center core element is asymmetric relative to a dividing plane parallel with the mounting plane and including the longitudinal axis, such that a greater portion of the center core element lies on a side of the dividing plane adjacent the mounting plane than on an opposite side of the dividing plane. In one preferred form, the asymmetric center core element has a cross-sectional shape resembling a "D" character turned on its side, or "lazy D" shape. Other asymmetric forms and shapes are clearly within the scope and contemplation of the present invention. The asymmetric center core element is formed of a second magnetic material which may be the same as, or different from, the first magnetic material.

In one preferred embodiment at least one coil is wound upon a bobbin of non-magnetic, dielectric material defining a central lumen having an asymmetric cross-section to match and receive the two center core elements. Energy transfer into the magnetic core via the coil is maximized by providing abbreviated sidewalls, thereby enabling the wound coil to extend to the outer limits of the core without impacting the maximum outer dimensions of the device. The bobbin typically includes outer flanges and mounting bosses having bottom surfaces facing the mounting plane. Terminal posts or wires extend from the bottom surfaces. Terminal ends of at least one coil are wrapped around the terminal posts and enable the device to be surface-mounted to aligned conductive traces of the PCB.

In another preferred embodiment at least one coil is formed as a coil preform without the bobbin, such that it defines a central lumen having an asymmetric cross-section to match and receive the two center core elements. In this embodiment, terminal ends of the coil are positioned to provide terminal contacts to the PCB.

A suitable closure mechanism, such as a clip, a band, a tape, an encapsulating material or an adhesive or glue, is provided to clamp the two core halves together around the asymmetric center core element to hold and maintain the at least one coil, the asymmetric core element if it is separate from the core halves, and a bobbin if present, between the two core halves.

Alternatively, because of resultant compactness, multiple devices may be included in a single unitary structure, thereby minimizing PCB space, assembly time, and element packaging material.

Alternatively, various electrical devices mounted in alternative mounting arrangements to a PCB may utilize a core structure having a center core element that is asymmetric relative to a dividing plane perpendicular with the PCB mounting plane.

These and other objects, advantages, aspects and features of the present invention will be more fully understood and appreciated upon consideration of the detailed description of preferred embodiments presented in conjunction with the following drawings.

BRIEF DESCRIPTION OF THE DRAWINGS

The invention is illustrated by the drawings in which FIG. 1 is an isometric assembly view of a device in accordance with principles of the present invention mounted and connected to a PCB substrate.

FIG. 2 is an isometric face view of one part of a two-part magnetic core element in accordance with principles of the present invention.

FIG. 3 is an isometric back view of one part of the two-part magnetic core of the device shown in FIG. 1.

FIG. 4 is a diagrammatic view in side elevation of the face view of the one part shown in FIG. 3 wherein coil windings are shown in dashed outline to illustrate a uniform interior volume between facing surfaces of the abbreviated skirt and the asymmetric center core element.

DETAILED DESCRIPTION OF THE INVENTION

Figure 7:
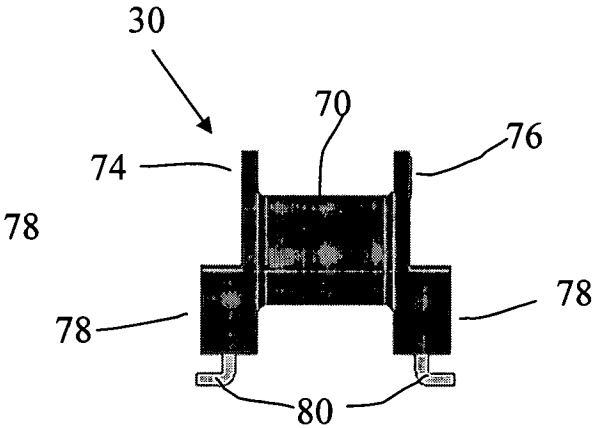
FIG. 7 is an end view in elevation of the FIG. 5 bobbin element.

Electrical devices in accordance with the present invention form an inductor if there is at least one coil present, and a transformer if there are at least two mutually-coupled coils present. In this specification, the word "device" includes both inductors and transformers.

FIG. 1 shows an assembly view of a device 10 incorporating principles of the present invention. The device 10 has at least two mutually-coupled coils and therefore functions as a transformer. As shown in FIG. 1, the device 10 is surface-mounted, i.e., by a solder reflow process, directly to aligned traces 12 of a PCB 14 thereby to connect coil terminal ends with associated circuitry (not shown) of an electrical circuit including the PCB 14, and thereby mechanically to secure the device 10 to the PCB 14. Alternatively, the device 10 may be provided with dependent pins enabling the device to be through-hole mounted to the PCB.

The device 10 includes a first core half 16 and a second core half 26. In this embodiment, the first and second core halves 16 and 26 are positioned around a bobbin 30. A metal clip 32 has a plurality of opposed spring finger sets 34, 36. The fingers of set 34 include detents engaging aligned recesses 18 of core half 26, and the fingers of set 36 include detents engaging aligned recesses of core half 16. The recesses 18 are shown in the core half back view of FIG. 3. The first core half 16 has the same face geometry as the second core half 26, but may have a different transverse length than the second core half 26. However, for ease of assembly and lowest manufacturing cost, the first core half 16 and the second core half 26 are most preferably substantially identical. As a consequence, only the first core half 16 is described in detail herein, it being understood that the description thereof applies equally to the second core half 26.

The bobbin 30 shown in the FIG. 1 assembly view includes a pair of feet or bosses 78. Each boss 78 may be provided with a top surface curved to match a curved contour of a backwall edge of each core half. In the core half example presented in FIGS. 1, 3 and 4, a backwall 50 has two curved corners 51 which adjacently abut curved surfaces 79 of the bobbin bosses 78. In the FIG. 2 example, a backwall 53 is formed without the curved corners 51, and a bobbin for that backwall 53 would have flat bosses, rather than the corner curved bosses 78 shown in FIG. 1.

In accordance with principles of the present invention, the first core half 16, which is shown in more detail in FIGS. 2 to 4, comprises an outer skirt 42 formed from abbreviated first and second side walls 44, 46 connected by top wall 48.

By "abbreviated" is meant that the first and second side walls 44, 46 of the skirt 42 are shortened from the top wall 48 to a dependent distance $S_H$ and do not extend to or near the bottom of the core half 16, 26 over distance $B_H$. The abbreviated skirt 42 also defines an inner surface 43 that is complementary to a facing surface 63 of an asymmetric center core element 60, so that an interior volume V for receiving a coil or coils is substantially uniform along the extent of inner surface 43. A single coil 15 is shown in phantom outline in FIG. 4 in order to illustrate the uniform interior volume V provided by surface 43 and surface 63. This arrangement thereby maximizes a substantially uniform volume enclosed by the resultant shield formed by the two core halves 16, 26 which can be utilized to contain the coil winding(s) and the asymmetric center core element 60. In order to provide shielding and minimize electromagnetic distortion, the surface contours joining the sidewalls 44, 46 and top wall 48 are curved, not square. A backwall 50 is attached to or extends from the outer skirt 42 to form a semi-enclosed housing, having a front open space 52. The backwall 50 may have curved lower corners 51 shown in FIGS. 1, 3 and 4, or it may have substantially square corners as shown in FIG. 2.

The front edges of the first and second side walls 44, 46 and the top wall 48 form a first face 54, which lies in a face plane marking an outer extent of the front open space 52. The outer skirt 42 and the backwall 50 are most preferably formed as an integral structure of suitable magnetic material having a first magnetic permeability characteristic, hereafter "first magnetic material".

A center core element 60 is integrally formed with, attached to, or positioned to, the backwall 50 and the core element 60 extends from the first backwall 50. If the first outer skirt 42, the backwall 50, and the center core element 60 are manufactured via a single molding procedure, the center core element 60 may be integrally attached to the backwall 50. Otherwise, the center core element 60 may be attached by any suitable means, e.g. by an adhesive, direct physical contact maintained in position by a clip or other article, or by the use of a spacer between the center core element and the backwall 50.

Figure 10:
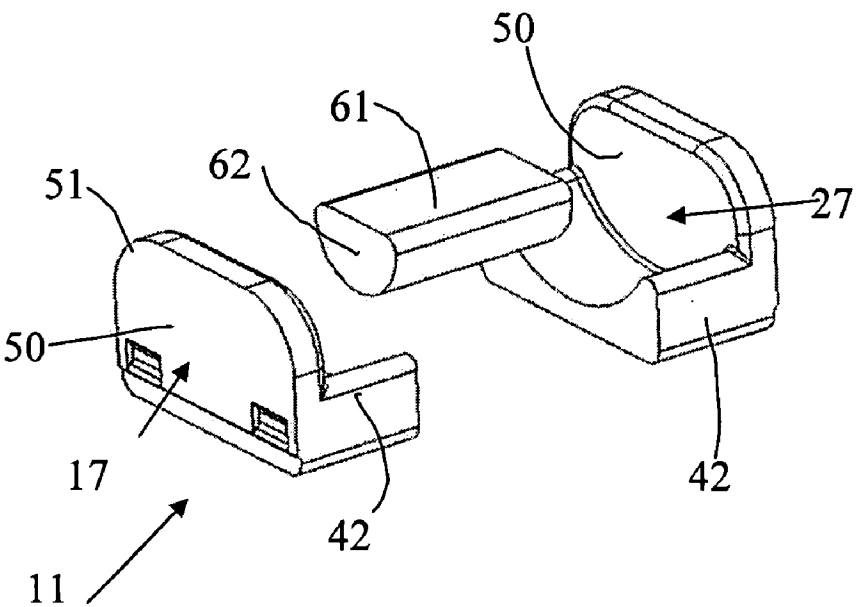
FIG. 10 is an exploded view of two core halves having abbreviated skirt elements and a discrete asymmetric center core element sized to fit in an interior space between backwalls of the center core elements, in accordance with principles of the present invention.

In some applications and embodiments, the center core element may not be directly attached to the backwall 50. As shown in FIG. 10, an alternative embodiment 11 of the present invention includes two facing core halves 17, 27 having abbreviated skirts 42 and a single discrete asymmetric center core element 61 having an axial length that extends across both core halves. The center core element 61 may be sized to contact facing backwalls 50 of the core halves 17, 27, or one or two magnetic gaps may be formed between confronting end faces 62 of the center core element 61 and the backwalls 50. In this alternative arrangement, the center core element 61 may be mounted inside a coil or bobbin, which is then enclosed within the two core halves 17, 27 not having a center core element. Single or multiple magnetic gaps to control flux saturation level may be realized readily with this approach.

In accordance with principles of the present invention, the cross-section of the center core element 60, 61 is asymmetric about a dividing plane $P_D$ lying parallel to a mounting plane $P_B$ of PCB 14 and including a longitudinal axis and the centroid C of the center core element. In the illustrated arrangement the center core element 60, 61 may be divided into symmetrical halves along a third plane $P_N$ normal to the dividing plane $P_D$ and mounting plane $P_B$, but it cannot be divided into symmetrical halves along the dividing plane $P_D$. In order to maintain desired height compaction of the device 10 a ratio of a horizontal dimension of the center core element taken along dividing plane PD to vertical dimension of the center core element 60, 61 taken along the normal plane PN is at least 1:1, and is at most 3.5:1.

The cross-section of center core element 60, 61 may follow a wide variety of asymmetric shapes and curves including parabolic, cycloidal, triangular, etc. Presently most preferred is a curved-edge lazy D shape as shown in FIG. 4 wherein the major arc of the cross-sectional shape lies above the dividing plane $P_D$ and the centroid C of the center core element, leaving the majority of the mass thereof below the dividing plane PD and centroid C.

The position of attachment of the center core element 60 to the backwall 50 is an important aspect of the invention. The center core element 60 is attached so that a longitudinal axis thereof passing through the centroid C is perpendicular to the backwall 50, as well as parallel to the circuit board 14, when mounted, as shown in FIG. 1. If the center core element 61 is formed separately from the outer skirt 42 and backwall 50, the center core element 61 may be glued or otherwise fixed to the backwall 50 by a suitable adhesive, or alternatively, the element 61 and backwall 50 (along with the outer skirt 42) may be glued or otherwise fixed to an intermediate structure, such as the bobbin 30.

The center core element 60, 61 comprises a magnetic material having a predetermined magnetic permeability characteristic, and it may be the same as the first magnetic material or a second magnetic material which may be comprised of a single or a plurality of magnetic core materials with different permeabilities and has a permeability different than the first magnetic material. The first and second magnetic materials may be ferrite or ferrous (iron) powder. Preferably, although not necessarily, the first and second core halves 16, 26 are formed as integral structures from a ferrite material by use of ceramic forming processes including press-forming and high temperature sintering. The exposed surfaces and contours of the integrated core half 16, 26 are designed to facilitate removal of the molded part from a mold, as is known in the art.

Alternative fabrication methods include press-molding and cure, or injection-molding and cure. The semi-enclosed housing comprising the outer skirt 42 and backwall 50 may be made from the first magnetic material, while the core element 60, 61 may be made from the second homogenous or composite magnetic material, in order to realize an electrical device having a high initial inductance that is still able to handle large amounts of current before reaching a flux saturation level. In other circumstances, use of first and second magnetic materials enables realization of an electrical device with desired magnetic properties using readily available materials, rather than requiring formulation of new or unusual magnetic materials. Practical examples include composite cores and swinging chokes.

The cross-sectional area of the backwall 50 and outer skirt 42 should be kept as close as possible to the cross-sectional area of the center core element 60, 61, and should never be smaller than the cross sectional area of core element 60, 61. The cross-section geometry of the backwall 50 is generally rectangular, while the cross-section geometry of the outer skirt 42 has three flat walls 44, 46 and 48 on the exterior and a concentrically contoured interior surface 43 substantially coaxial with a longitudinal axis at the intersection of the dividing plane $P_D$ and the normal plane $P_N$ in the embodiment shown in FIG. 4 for example. Outer skirt 42 and backwall 50 contribute to low electromagnetic distortion and relatively high shielding of center core element 60 by maximizing the space directly above the mounting plane PB on the PCB 14 to provide a high permeability path, as compared to air, to help contain magnetic flux of the coil(s) of device 10 as efficiently as possible. An outer face wall 62 of the center core element 60 may lie in the plane including the face 54 of the outer skirt 42, so that when the core halves 16 and 26 are placed into a facially confronting relationship, as shown in FIG. 1, the face wall 62 contacts the oppositely facing face wall of the other core half. Alternatively, the face wall 62 may be inset a predetermined distance away from the plane of the outer skirt face 54, in order to form a magnetic gap to alter the magnetic saturation characteristics of device 10, as is known in the art.

Second core half 26 is preferably identical to first core half 16, and second core half 27 is preferably identical to first core half 17, although for some applications, the longitudinal length dimension of the second center core half may be different from that of the first core half.

The bobbin 30 is shown in FIG. 1 and in more detail in FIGS. 5 to 8. Bobbin 30, generally made by injection molding of a thermosetting dielectric polymer material, has an exterior surface 70 and defines a hollow center opening or lumen 72, which, most preferably has the same geometry as cross-sections of the center core element 60, 61 and it has an opening size dimensioned to receive the center core element in a snug-fitting relationship, to minimize air gaps between the coil wound on the bobbin and the center core to minimize air gaps between the coil wound on the bobbin and the center core elements 60, 61. Bobbin 30 is formed with, or attached to, first and second peripheral flanges 74, 76. The coil or coils are wound on the bobbin in a volume limited along the longitudinal axis by the distance between the peripheral flanges 74, 76.

Positioned along the bottom of the first and second flanges 74, 76 are the bosses 78. These bosses 78 include spaced-apart mounting wires or mounting posts 80 separated by wire routing channels 82, to enable separation and control of individual windings of the coils around the exterior surface of the bobbin 30. The mounting wires or posts 80 enable terminal end wires of the coils to be terminated, and then to be soldered or otherwise attached, directly to trace pads 12 on the exemplary PCB 14 in a self-terminating fashion. The wire mounting posts 80 may or may not extend beyond the footprint of the first and second core halves when the device is assembled, thereby enabling the device 10 to take up a minimally optimized amount of PCB area.

The lack of sharp edges on all the elements of the device 10 reduces winding stress, excessive resistance, and excessive leakage inductances. In particular, the smoothly contoured shape of the bobbin 30 lends itself readily to a number of different types of electrical conductors, e.g. square, round, rectangular, and multi-filar windings. The smooth contours ensure that a minimal amount of space is wasted and volumetric efficiency is kept high, as well as limiting mechanical damage during assembly due to variability of core positioning.

Both first and second core halves 16, 26 are assembled over the bobbin 30, with the center core element 60 of each half 16, 26 being inserted into the central lumen 72 of the bobbin 30. The core elements 16 and 26 are designed so that when they are assembled in the device 10 to form the magnetic core structure, the core halves, at least at the confronting faces 54 of the outer skirts 42, are in contact with one another to provide a closed magnetic path, for shielding purposes and to provide an acceptable level of electromagnetic distortion.

To optimize the volume utilized by the core structure above a given mounting area, the cross-sectional area of the core composite structure must be chosen so that acceptable performance, in terms of a given flux density, core power loss, or total harmonic distortion, can be obtained.

Figure 9:
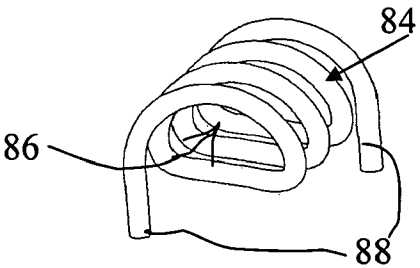
FIG. 9 is an isometric view of a coil preform that may be formed and used in lieu of the FIG. 5 bobbin within the FIG. 1 device in accordance with principles of the present invention.
Figure 8:
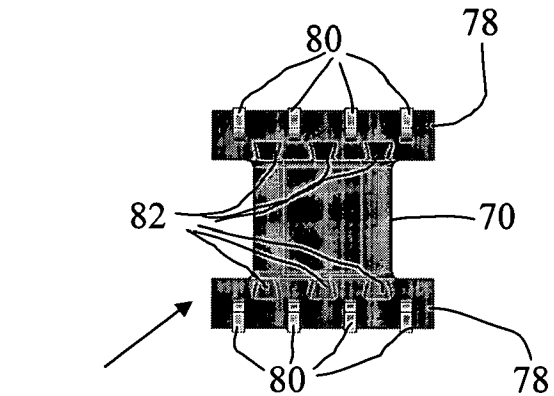
FIG. 8 is a bottom view in elevation of the FIG. 5 bobbin element.

Turning now to FIG. 9, in some instances it may be preferable to wind one or more conductors over an asymmetric mandrel to form a self-supporting coil or transformer preform, such as a coil 84. In the FIG. 9 example, coil 84 defines a central asymmetric lumen 86 corresponding to the geometry of the center core portion 60 without requiring use of a bobbin. A suitable adhesive, coil dope, or similar method may be used to coat the windings so that the resultant coil preform 84 maintains its desired shape. This approach may be particularly advantageous where coil wire diameter is relatively large. With large coil wire diameters, it is practical to form the ends of coil preform 84 such that conductor ends form connection pads or through-hole leads 88 in lieu of the connection posts 80 of the bobbin 30. An electrical device 10 in accordance with the present invention is realized by placing the two core halves 16, 26 together around the preform 84, and securing the resultant assembly together, as with the metal clip 32 shown in connection with device 10 in FIG. 1, or by any other suitable mechanism such as adhesive or glue, tape, or a strap, for example. An electrical device 11 in accordance with the FIG. 10 embodiment of the present invention is realized by positioning and securing the asymmetric center core element 61 in position in the lumen 86 of the coil preform 84 and then bringing the two core halves 17, 27 together around the preform 84 and core 61 and securing the resultant assembly together, preferably by glue, adhesive or potting compound, or by use of a similar method, for example.

Figure 6:
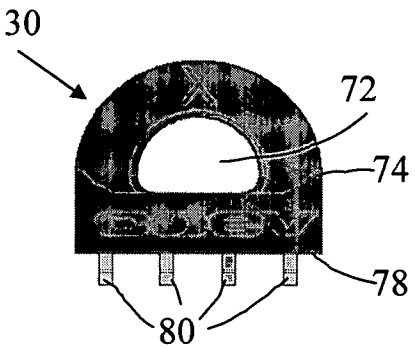
FIG. 6 is a side view in elevation of the FIG. 5 bobbin element.
Figure 5:
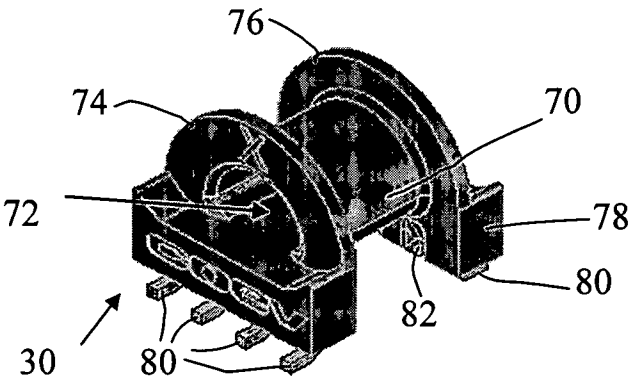
FIG. 5 is an isometric view of a bobbin element of the FIG. 1 device.
Figure 11:
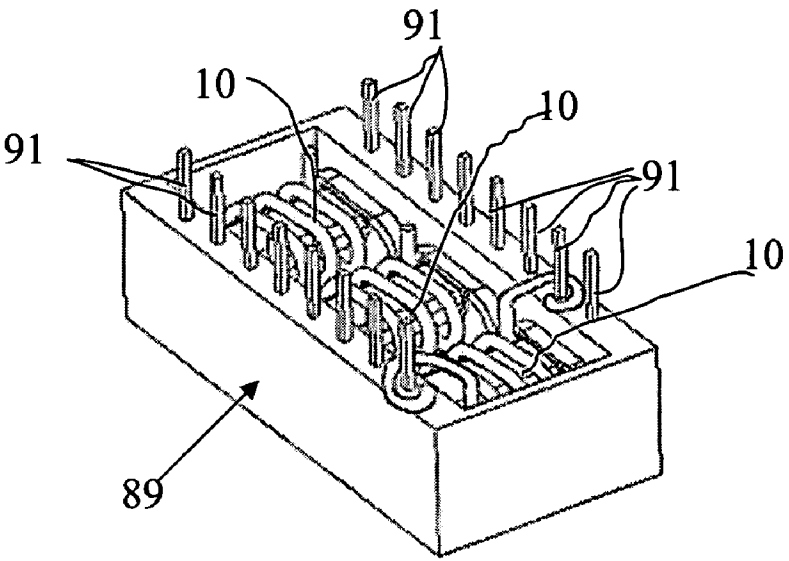
FIG. 11 is a bottom isometric view of a unitary structure containing multiple devices of the present invention arranged in a package adapted for automated assembly using through-hole terminals.

FIG. 11 sets forth an example of a single housing 89 containing, for example, three devices 10 or 11 of the present invention. The multi-device housing 89 may be formed in the same manner and of the same material as the bobbin 30 described above. A series of mounting wires or terminals 91 extend from the single housing 89 and enable the multi-device to be surface mounted to, or inserted into through-hole vias of, a PCB and enable the electromagnetic devices 10 therein to be electrically connected to circuitry of the PCB. In the FIG. 11 embodiment the wires or terminals 91 are arranged to be perpendicular to the mounting plane of the PCB, thereby providing for conventional through-hole mounting of the structure to the PCB and electrical connection to aligned traces thereof. The devices 10, 11 can be packaged as a unitary structure 89 as shown in FIG. 10 with integrated terminals 91. Alternatively, each device 10, 11 may include a separate bobbin 30 which may or many not have terminals 80 and bosses 78 as shown in FIG. 6, for example. The FIG. 11 single unitary structure 89 is particularly well suited for automated PCB assembly operation and minimizes PCB space, assembly time, and element packaging material.

For efficiency and usefulness, ferrite cores used for these applications preferably meet a number of criteria, including small size so as to minimize the footprint on a printed circuit board (PCB). The shape of the core establishes a high degree of self-shielding in order to minimize radiated emissions which may affect adjacent elements, especially at higher frequencies and drive levels. The area occupied by the transformer or inductor device of the present invention on the PCB is small and the volumetric efficiency is high in order to achieve high circuit densities. Openings in the core allow the coil windings to be terminated easily on a bobbin prior to core assembly, although some wires may extend beyond the core. In addition, openings in the core may be mounted in a preferred orientation, i.e. facing the PCB where use of a ground plane can most easily minimize undesirable effects such as radiated emissions or susceptibility to EMI and cross-talk. When the core is in the form of two pieces, the core halves are held in intimate contact by a fastening means, e.g. adhesive, tape, potting compound, or the clip 32, to complete a magnetic circuit and to reduce product variability. Finally, for optimum core saturation characteristics, the magnetic path is relatively uniform in cross-sectional area across its entire length.

Electrical devices of the invention are particularly useful as transformers or inductors in a power supply, data, or telecommunications circuit. Such telecommunications or data circuits generally operate below 1000 MHz, while power circuits generally have a power output of less than 1000 W. Those skilled in the art will appreciate that the asymmetric center core element may be provided in a device with core halves defining full-length skirts. Alternatively, the device may include core halves having abbreviated skirts and a symmetric center core element. Most preferably, however, the devices in accordance with the invention will include both abbreviated skirts and asymmetric core elements.

Having thus described preferred embodiments of the invention, it will now be appreciated that the objects of the invention have been fully achieved, and it will be understood by those skilled in the art that many changes in construction and widely differing embodiments and applications of the invention will suggest themselves without departing from the spirit and scope of the invention. Therefore, the disclosures and descriptions herein are purely illustrative and are not intended to be in any sense limiting.

What is claimed is:

1. An electrical device for mounting on a printed circuit board (PCB) defining a mounting plane, the device including a magnetic core structure of first and second core parts and at least one coil within the magnetic core structure, each one of the first and second core parts comprising:

(a) a backwall and an outer skirt portion extending from the backwall, the core part being formed of a first magnetic material;

(b) an asymmetric center core element formed of a second magnetic material and extending from the backwall in the same direction as the outer skirt along a longitudinal axis parallel with the mounting plane and including a centroid of the center core element, the outer skirt and the center core element defining a generally uniform volume for the at least one coil, a cross-section of the center core element being asymmetric relative to a dividing plane and including the longitudinal axis, such that a greater portion of the mass of the center core element lies on one side of the dividing plane and a lesser portion of the mass of the center core element lies on an opposite side of the dividing plane;

(c) the at least one coil defining a longitudinal lumen shaped to be similar to the cross-section of the center core element and sized to receive the center core element in a close-fitting relationship when the device is assembled and having terminal ends arranged to connect to connection traces formed on the PCB; and (d) outer face areas of each outer skirt portion being in substantial contact when the first and second core halves are brought together upon assembly of the device.

2. The electrical device set forth in claim 1 wherein the backwall has a predetermined height above a mounting plane and wherein the outer skirt portion has a topwall and abbreviated outer sidewalls that extend from the topwall for a distance less than the predetermined height.

3. The electrical device set forth in claim 1 wherein the, outer skirt defines an interior surface which is complementary to a facing surface portion of the asymmetric center core element, thereby providing the generally uniform volume.

4. The electrical device set forth in claim 1 wherein the dividing plane is parallel with the mounting plane and wherein a greater portion of the mass of the asymmetric center core element lies on a side of the dividing plane adjacent to the mounting plane.

5. The electrical device set forth in claim 1 wherein the first magnetic material and the second magnetic material have the same magnetic permeability, and each core half is formed as a unitary structure including the asymmetric center core element.

6. The electrical device set forth in claim 1 wherein the second magnetic material is one of homogenous and composite magnetic constituents, the first magnetic material has a different magnetic permeability than a magnetic permeability of the second magnetic material, and the center core element is positioned and mechanically secured within the device by core positioning and securing means.

7. The electrical device set forth in claim 5 further comprising a bobbin of non-magnetic, dielectric material defining a central lumen having an asymmetric cross-section to match and receive each center core element, the at least one coil being wound on the bobbin, and the first and second core halves being positioned relative to each other by assembly with the bobbin.

8. The electrical device set forth in claim 2 wherein the center core element has a cross-sectional shape resembling a "D" character turned on its side and wherein an interior surface of the abbreviated skirt portion is generally coaxial with the longitudinal axis of the asymmetric center core element, thereby providing the generally uniform volume for the at least one coil.

9. The electrical device set forth in claim 1 wherein the cross-section of the center core element has a ratio of a dimension taken along the dividing plane to a dimension through and normal to the longitudinal axis which is in a range including 1 to 1 and 3.5 to 1.

10. The electrical device set forth in claim 1 wherein the first magnetic material has a different magnetic permeability than a magnetic permeability of the second magnetic material, and wherein the center core element is not secured directly to the backwall, and is maintained in position by a positioning means comprising one of a bobbin and the at least one coil.

11. The electrical device set forth in claim 1 wherein the asymmetric center core element is asymmetrical relative to a dividing plane perpendicular with the mounting plane.

12. The electrical device set forth in claim 1 wherein the asymmetric center core element is discrete relative to the first and second core halves and is positioned relative to the first and second core halves by placement within the longitudinal lumen formed by the at least one coil.

13. The electrical device set forth in claim 12 wherein the discrete asymmetric center core element is positioned relative to the first and second core halves by placement within a longitudinal lumen of a bobbin around which the at least one coil is wound.

14. The electrical device set forth in claim 1 wherein the at least one coil is wound upon a bobbin of non-magnetic, dielectric material defining a central lumen having an asymmetric cross-section to match and receive each center core element, the bobbin including outer flanges and mounting bosses having bottom surfaces facing the mounting plane, and terminal posts extending from the bottom surfaces, terminal ends of the at least one coil being wrapped around the terminal posts to enable said device to be surface-mounted to aligned traces of the PCB.

15. The electrical device set forth in claim 1 wherein the at least one coil is wound upon a bobbin of non-magnetic, dielectric material defining a central lumen having an asymmetric cross-section to match and receive each center core element, the bobbin including outer flanges and mounting bosses having bottom surfaces facing the mounting plane, and terminal ends connected to said at least one coil and extending perpendicularly from the bottom surfaces to enable said device to be through-hole mounted and connected to traces of the PCB.

16. The electrical device set forth in claim 1 wherein the at least one coil is formed as a preform and is mounted in the device without a bobbin.

17. The electrical device set forth in claim 5 wherein outer face areas of each center core element are in substantial contact when the core halves are brought together upon assembly of the device.

18. The electrical device set forth in claim 5 wherein outer face areas of each center core element are spaced apart to define a magnetic gap when the first and second core halves are brought together upon assembly of the device.

19. The electrical device set forth in claim 1 further comprising a binding means for holding and maintaining the first and second core halves together upon assembly of the device.

20. An electrical device for mounting on a printed circuit board (PCB) defining a mounting plane includes a two-part magnetic core structure and at least one coil included within the two-part magnetic core structure having first and second core halves, each of the first and second core halves comprising:

(a) a backwall and an abbreviated outer skirt portion extending from the backwall fonned of a first magnetic material, wherein the backwall has a predetermined height above a mounting plane and wherein the outer skirt portion has a topwall and outer sidewalls that extend from the topwall for a distance less than the predetermined height;

(b) a center core element formed of a second magnetic material and extending from the backwall in the same direction as the outer skirt along a longitudinal axis parallel with the mounting plane, the outer skirt and the center core element defining a generally uniform volume for the at least one coil;

(c) the at least one coil defining a longitudinal lumen shaped to be similar to the cross-section of the center core element and sized to receive the center core element in a close-fitting relationship when the device is assembled and having terminal ends arranged to connect to connection traces formed on the PCB; and (d) outer face areas of each outer skirt portion being in substantial contact when the first and second core halves are brought together upon assembly of the device.

21. The electrical device set forth in claim 20 wherein a centroid of the center core element lies along the longitudinal axis and a cross-section of the center core element is asymmetric relative to a dividing plane including the longitudinal axis, such that a greater portion of the mass of the center core element lies on one side of the dividing plane and a lesser portion of the mass of the center core element lies on an opposite side of the dividing plane.

22. The electrical device set forth in claim 21 wherein the outer skirt defines an interior surface which is complementary to a facing surface portion of the asymmetric center core element, thereby providing the generally uniform volume.

23. The electrical device set forth in claim 21 wherein the dividing plane is parallel to the mounting plane and a greater portion of the mass of the center core element lies on a side of the dividing plane adjacent to the mounting plane.

24. The electrical device set forth in claim 20 wherein the first magnetic material and the second magnetic material have the same magnetic permeability, and each core half is formed as a unitary structure including the center core element.

25. The electrical device set forth in claim 20 wherein the second magnetic material is one of homogenous and composite magnetic constituents, the first magnetic material has a different magnetic permeability than a magnetic permeability of the second magnetic material, and the center core element is positioned and mechanically secured in the device by positioning and securing means.

26. The electrical device set forth in claim 20 further comprising a bobbin of non-magnetic, dielectric material defining a central lumen having a cross-section to match and receive each center core element, the at least one coil being wound on the bobbin, and the first and second core halves being positioned relative to each other by assembly with the bobbin.

27. The electrical device set forth in claim 20 wherein the first magnetic material has a different magnetic permeability than a magnetic permeability of the second magnetic material, and wherein the center core element is not secured directly to the backwall, and is maintained in position by a positioning means comprising one of a bobbin and the at least one coil.

28. The electrical device set forth in claim 20 wherein the center core element is discrete relative to the first and second core halves and is positioned relative to the first and second core halves by placement within the longitudinal lumen formed by the at least one coil.

29. The electrical device set forth in claim 28 wherein the discrete center core element is positioned relative to the first and second core halves by placement within a longitudinal lumen of a bobbin around which the at least one coil is wound.

30. The electrical device set forth in claim 20 wherein the at least one coil is wound upon a bobbin of non-magnetic, dielectric material defining a central lumen having a cross-section to match and receive each center core element, the bobbin including outer flanges and mounting bosses having bottom surfaces facing the mounting plane, and terminal posts extending from the bottom surfaces, terminal ends of the at least one coil being wrapped around the terminal posts to enable said device to be surface-mounted to aligned traces of the PCB.

31. The electrical device set forth in claim 20 wherein the at least one coil is wound upon a bobbin of non-magnetic, dielectric material defining a central lumen having a cross-section to match and receive each center core element, the bobbin including outer flanges and mounting bosses having bottom surfaces facing the mounting plane, and terminal ends connected to said at least one coil and extending perpendicularly from the bottom surfaces to enable said device to be through-hole mounted and connected to traces of the PCB.

32. The electrical device set forth in claim 20 wherein the at least one coil is formed as a preform and is mounted in the device without a bobbin.

33. The electrical device set forth in claim 20 wherein outer face areas of each center core element are in substantial contact when the core halves are brought together upon assembly of the device.

34. The electrical device set forth in claim 20 wherein outer face areas of each center core element are spaced apart to define a magnetic gap when the first and second core halves are brought together upon assembly of the device.

35. The electrical device set forth in claim 20 further comprising a binding means for holding and maintaining the first and second core halves together upon assembly of the device.

36. An electrical device for mounting on a printed circuit board (PCB) defining a mounting plane comprises a magnetic core structure and at least one coil within the magnetic core structure, the magnetic core structure having first and second core halves, each one of the first and second core halves comprising a backwall and an abbreviated outer skirt portion extending from the backwall, wherein the backwall has a predetermined height above a mounting plane and wherein the outer skirt portion has a topwall and outer sidewalls that extend from the topwall for a distance less than the predetermined height, the core half being formed of a first magnetic material;

an asymmetric center core element formed of a second magnetic material and extending from the backwall in the same direction as the outer skirt along a longitudinal axis parallel with the mounting plane and including the centroid of the center core element;

the outer skirt portion defining an interior surface which is complementary to a facing surface portion of the asymmetric center core element thereby providing a generally uniform interior volume for the at least one coil;

a cross-section of the center core element being asymmetric relative to a dividing plane parallel with the mounting plane and including the longitudinal axis, such that a greater portion of the mass of the center core element lies on one side of the dividing plane and a lesser portion of the mass of the center core element lies on an opposite side of the dividing plane;

a bobbin of non-magnetic, dielectric material defining a central lumen having an asymmetric cross-section to match and receive the center core element, the at least one coil being wound on the bobbin;

the bobbin including outer flanges and mounting bosses having bottom surfaces facing the mounting plane, and terminal ends connected to said at least one coil and extending from the bottom surfaces to enable said device to be mounted and connected to the PCB; and binding means for holding and maintaining the first and second core halves and bobbin together upon assembly of the device.

37. The device set forth in claim 36 wherein the asymmetric center core element is formed of two center core parts, each center core part being integral with a corresponding one of the first and second core halves.

38. An electrical device comprising a unitary housing containing a plurality of electrical devices, each device including:

a two-part magnetic core structure and at least one coil included within the two-part magnetic core structure having first and second core halves, each core half comprising:

(a) a first part comprising a backwall and an abbreviated outer skirt portion extending from the backwall, the first part being formed of a first magnetic material, wherein the backwall has a predetermined height above a mounting plane and wherein the outer skirt portion has a topwall and outer sidewalls that extend from the topwall for a distance less than the predetermined height; and (b) an asymmetric center core element formed of a second magnetic material and extending from the backwall in the same direction as the outer skirt along a longitudinal axis parallel with the mounting plane and including the centroid of the center core element, the outer skirt and the center core element defining a generally uniform volume for the at least one coil, a cross-section of the center core element being asymmetric relative to a dividing plane parallel with the mounting plane and including the longitudinal axis, such that a greater portion of the mass of the center core element lies on one side of the dividing plane and a lesser portion of the mass of the center core element lies on an opposite side of the dividing plane;

(c) the at least one coil defining a longitudinal lumen shaped to be similar to the cross-section of the center core element and sized to receive the center core element in a close-fitting, relationship when the device is assembled and having terminal ends arranged to connect to connection traces formed on the PCB; and (d) outer face areas of each outer skirt portion being in substantial contact when the first and second core halves are brought together upon assembly of the device.

* * * * *